US008641480B2

(12) United States Patent
Nakanishi et al.

(10) Patent No.: US 8,641,480 B2
(45) Date of Patent: Feb. 4, 2014

(54) POLISHING APPARATUS AND POLISHING METHOD

(75) Inventors: Masayuki Nakanishi, Tokyo (JP); Tetsuji Togawa, Tokyo (JP); Kenya Ito, Tokyo (JP); Masaya Seki, Tokyo (JP); Kenji Iwade, Hiratsuka (JP); Takeo Kubota, Kuwana (JP); Takeshi Nishioka, Yokohama (JP)

(73) Assignees: Ebara Corporation, Tokyo (JP); Kabushiki Kaisha Toshiba, Tokyo (JP)

( * ) Notice: Subject to any disclaimer, the term of this patent is extended or adjusted under 35 U.S.C. 154(b) by 425 days.

(21) Appl. No.: 13/036,114

(22) Filed: Feb. 28, 2011

(65) Prior Publication Data

US 2011/0217906 A1 Sep. 8, 2011

(30) Foreign Application Priority Data

Mar. 2, 2010 (JP) ..... 2010-044846

(51) Int. Cl.
*B24B 1/00* (2006.01)

(52) U.S. Cl.
USPC ..... 451/56; 451/44; 451/72; 451/168; 451/443; 451/444

(58) Field of Classification Search
USPC ..... 451/56, 44, 72, 168, 296, 444, 443, 457
See application file for complete search history.

(56) References Cited

U.S. PATENT DOCUMENTS

| | | | | |
|---|---|---|---|---|
| 3,596,413 | A * | 8/1971 | Stewart | 451/444 |
| 3,753,269 | A * | 8/1973 | Budman | 15/160 |
| 4,525,955 | A * | 7/1985 | Cothrell et al. | 451/296 |
| 5,733,181 | A * | 3/1998 | Hasegawa et al. | 451/168 |
| 6,062,955 | A * | 5/2000 | Liu | 451/72 |
| 6,319,105 | B1 * | 11/2001 | Togawa et al. | 451/287 |
| 6,402,596 | B1 * | 6/2002 | Hakomori et al. | 451/44 |
| 6,558,239 | B2 * | 5/2003 | Kunisawa et al. | 451/303 |
| 6,705,929 | B1 * | 3/2004 | Nishimoto et al. | 451/72 |
| 7,862,402 | B2 * | 1/2011 | Hongo et al. | 451/5 |
| 8,152,598 | B2 * | 4/2012 | Fukushima et al. | 451/11 |
| 2001/0011002 | A1 * | 8/2001 | Steere, III | 451/168 |
| 2002/0098787 | A1 * | 7/2002 | Kunisawa et al. | 451/307 |
| 2005/0000826 | A1 * | 1/2005 | Qiao | 205/660 |
| 2005/0220986 | A1 * | 10/2005 | Selvamanickam et al. | 427/62 |
| 2008/0113509 | A1 * | 5/2008 | Sakairi | 438/690 |
| 2008/0254719 | A1 | 10/2008 | Shigeta et al. | |
| 2009/0142992 | A1 | 6/2009 | Takahashi et al. | |
| 2009/0227189 | A1 | 9/2009 | Maeda et al. | |

FOREIGN PATENT DOCUMENTS

| | | |
|---|---|---|
| JP | 04-085827 | 3/1992 |
| JP | 08-192360 | 7/1996 |
| JP | 2003-257917 | 9/2003 |
| JP | 2007-005661 | 1/2007 |
| JP | 2008-263027 | 10/2008 |
| JP | 2009-154285 | 7/2009 |
| JP | 2009-208214 | 9/2009 |

* cited by examiner

*Primary Examiner* — George Nguyen
(74) *Attorney, Agent, or Firm* — Wenderoth, Lind & Ponack, L.L.P.

(57) ABSTRACT

A polishing apparatus can effectively prevent abrasive particles from falling off a polishing tape during polishing. The polishing apparatus includes: a polishing head for polishing a peripheral portion of a substrate by pressing a surface of a polishing tape, having abrasive particles fixed on the surface, against the peripheral portion of the substrate while allowing the polishing tape to travel in one direction; and a conditioning apparatus, disposed upstream of the polishing head in the traveling direction of the polishing tape, for conditioning the surface of the polishing tape in advance in order to prevent the abrasive particles from falling off the surface of the polishing tape during polishing.

12 Claims, 9 Drawing Sheets

POLISHING APPARATUS AND POLISHING METHOD

BACKGROUND OF THE INVENTION

1. Field of the Invention

The present invention relates to a polishing apparatus and a polishing method for polishing a substrate, such as a semiconductor wafer, and more particularly to a polishing apparatus and a polishing method for polishing or grinding a peripheral portion of a front or back surface of a semiconductor wafer in a process of manufacturing a semiconductor device.

2. Description of the Related Art

In polishing of a peripheral surface portion (edge portion and bevel portion) of, e.g., a semiconductor wafer by the use of a polishing tape having abrasive particles fixed on a surface, it is common practice to press the surface of the polishing tape against the peripheral surface portion of the semiconductor wafer, rotating in a horizontal plane, at a predetermined pressure while supplying pure water to the surface of the semiconductor wafer.

In a semiconductor wafer W as shown in FIG. 10, the "bevel portion" of a semiconductor wafer herein refers to a portion B consisting of an upper inclined portion P and a lower inclined portion Q of an upper surface and a lower surface, respectively, of the semiconductor wafer W, and a peripheral side surface portion R of the semiconductor wafer W. The "edge portion" of a semiconductor wafer herein refers to a portion E lying between a boundary of the bevel portion B and a device area D of the upper surface, in which semiconductor devices are formed, of the semiconductor wafer W as shown in FIG. 10.

A method for polishing a peripheral portion (edge portion and bevel portion) of a silicon substrate has been proposed. The method comprises pressing a polishing tape, e.g., having ceria abrasive particles fixed thereon, against the peripheral portion of the silicon substrate, rotating in a horizontal plane, while supplying pure water to the peripheral portion (polishing portion) of the silicon substrate, thereby polishing away an insulating film and exposing the underlying silicon, and thereafter polishing the silicon by using a polishing tape having diamond abrasive particles which have a higher silicon polishing ability than ceria abrasive particles (see Japanese Patent Laid-Open Publication No. 2008-263027).

The applicant has proposed a polishing apparatus which can polish a peripheral portion of a substrate, including a flat portion, with a polishing tape while maintaining the original angle of the peripheral portion (see Japanese Patent Laid-Open Publication No. 2009-208214).

It has recently been proposed to manufacture an SOI (silicon-on-insulator) substrate by a bonding method which involves bonding, through heat treatment, two silicon substrates: a device substrate having semiconductor devices, and a supporting substrate. In a known method for manufacturing an SOI substrate, a first silicon substrate (device substrate), having a surface semiconductor layer (SIO layer) and whose peripheral surface portion has been polished away, and a second silicon substrate (supporting substrate), facing each other, are bonded via an insulting film, and then the back side of the first silicon substrate (device substrate) is polished or etched away, leaving the semiconductor layer (see Japanese Patent Laid-Open Publication No. H4-85827).

SUMMARY OF THE INVENTION

Polishing tapes are consumables, and a used old polishing tape is replaced with a new polishing tape. There is generally variation in the particle size of abrasive particles that are fixed on a surface of a commercially available polishing tape. Therefore, when a new commercially available polishing tape is used, as it is, in polishing of a substrate, relatively large-sized abrasive particles are likely to fall off the polishing tape during polishing. If abrasive particles fall off a polishing tape during polishing, the fallen abrasive particles will reach a surface being polished and can produce significant defects or flaws in the surface.

It is difficult to completely prevent abrasive particles from falling off a polishing tape during polishing. If abrasive particles fall off a polishing tape when a peripheral portion of a surface of a semiconductor wafer is being polished by pressing the polishing tape against the peripheral portion of the semiconductor wafer, rotating in a horizontal plane, while supplying pure water to the surface of the semiconductor wafer, the fallen abrasive particles will move toward the center of the semiconductor wafer and the pure water, covering the surface of the semiconductor wafer, will be contaminated with the abrasive particles. The higher the rotating speed of the semiconductor wafer is, the more the pure water will be contaminated with abrasive particles.

If pure water, covering a surface of a semiconductor wafer (silicon substrate), is contaminated with fallen abrasive particles during polishing of the peripheral surface portion of the silicon substrate (device substrate) having a surface semiconductor layer (SIO layer), the abrasive particles can cause damage to the semiconductor layer (SIO layer).

The present invention has been made in view of the above situation. It is therefore a first object of the present invention to provide a polishing apparatus and a polishing method which can effectively prevent abrasive particles from falling off a polishing tape during polishing.

It is a second object of the present invention to provide a polishing apparatus and a polishing method which, even if abrasive particles fall off a polishing tape during polishing of a peripheral surface portion of a substrate, can prevent the fallen abrasive particles from entering a central device area of the substrate.

In order to achieve the objects, the present invention provides a polishing apparatus comprising: a polishing head for polishing a peripheral portion of a substrate by pressing a surface of a polishing tape, having abrasive particles fixed on the surface, against the peripheral portion of the substrate while allowing the polishing tape to travel in one direction; and a conditioning apparatus, disposed upstream of the polishing head in the traveling direction of the polishing tape, for conditioning the surface of the polishing tape in advance in order to prevent the abrasive particles from falling off the surface of the polishing tape during polishing.

According to the polishing apparatus, a surface of a polishing tape is conditioned in advance by the conditioning apparatus in order to prevent abrasive particles from falling off the surface of the polishing tape during polishing, and the conditioned polishing tape is continuously fed to the polishing head during polishing. Accordingly, a commercially available polishing tape, as it is, for example, can be set in the polishing apparatus and used for polishing of a substrate.

In a preferred aspect of the present invention, the conditioning apparatus is a cleaning apparatus for cleaning the surface of the polishing tape by rubbing a rubbing tool against the surface of the polishing tape.

The cleaning apparatus, while cleaning a surface of a polishing tape with the rubbing tool, can rub off those abrasive particles of the abrasive particles fixed on the surface of the polishing tape, which have low adhesion to the polishing tape, with the rubbing tool. This can effectively prevent abrasive particles from falling off the surface of the polishing tape during polishing.

The rubbing tool may preferably be a cleaning brush.

In a preferred aspect of the present invention, the polishing apparatus further comprises a cleaning tool for cleaning the rubbing tool.

The cleanliness of the rubbing tool, such as a cleaning brush, can be kept constant by cleaning the rubbing tool with a fluid, such as pure water or a liquid chemical, e.g., during conditioning of a polishing tape with the rubbing tool.

In a preferred aspect of the present invention, the conditioning apparatus is a fluid blowing apparatus for blowing a fluid toward the surface of the polishing tape.

The abrasive particles fixed on the surface of the polishing tape, which have low adhesion to the polishing tape, can be blown off and removed from the surface of the polishing tape by blowing a fluid toward the surface of the polishing tape by the fluid blowing apparatus. A liquid such as pure water, air or an inert gas such as nitrogen gas may be used as the fluid. The fluid may be an ultrasonically-vibrating fluid.

The use of an ultrasonically-vibrating fluid can enhance the effect of removing abrasive particles, having low adhesion to the polishing tape, from the surface of the polishing tape.

In a preferred aspect of the present invention, the conditioning apparatus is a suction apparatus for applying suction to the surface of the polishing tape.

The abrasive particles fixed on the surface of the polishing tape, which have low adhesion to the polishing tape, can be removed from the surface of the polishing tape by applying suction to the surface of the polishing tape by the suction apparatus.

In a preferred aspect of the present invention, the conditioning apparatus is a polishing apparatus for polishing the surface of the polishing tape by pressing a grinding stone against the surface of the polishing pad.

The abrasive particles fixed on the surface of the polishing tape, which have low adhesion to the polishing tape, can be removed from the surface of the polishing tape by polishing the surface of the polishing tape by the polishing apparatus.

In a preferred aspect of the present invention, the conditioning apparatus is an adhesive contact apparatus for bringing an adhesive having an adhesive surface into contact with the surface of the polishing tape.

The abrasive particles fixed on the surface of the polishing tape, which have low adhesion to the polishing tape, can be removed from the surface of the polishing tape by allowing the abrasive particles to adhere to the adhesive.

The present invention also provides a polishing apparatus comprising: a polishing head for polishing a peripheral portion of a substrate by pressing a surface of a polishing tape, having abrasive particles fixed on the surface, against the peripheral portion of the substrate while allowing the polishing tape to travel in one direction; and a surface protection apparatus, during polishing of the peripheral portion of the substrate by the polishing head, for protecting a central portion of the surface of the substrate from foreign matter produced by the polishing.

According to the polishing apparatus, even if abrasive particles fall off the polishing tape during polishing of the peripheral portion of the surface of the substrate with the polishing tape of the polishing head, the fallen abrasive particles can be prevented from entering the central portion, e.g., the device area, of the surface of the substrate.

In a preferred aspect of the present invention, the surface protection apparatus includes at least one of a shielding tool for surrounding and protecting the central portion of the surface of the substrate in such a manner as to prevent passage of the foreign matter therethrough and a fluid blowing nozzle for blowing a fluid toward the boundary between the central portion and the peripheral portion of the substrate.

The shielding tool may preferably be a PVA sponge disposed in contact with the surface of the substrate.

The use of a PVA sponge can more securely prevent fallen abrasive particles from entering the central portion, e.g., the device area, of the surface of the substrate while preventing the shielding tool (PVA sponge) from damaging the surface of the substrate.

The present invention also provides a polishing method comprising: conditioning a surface of a polishing tape in order to prevent abrasive particles from falling off the surface of the polishing tape during polishing; and polishing a peripheral portion of a substrate by pressing the conditioned surface of the polishing tape against the peripheral portion of the substrate.

The present invention also provides a polishing method comprising: polishing a peripheral portion of a substrate by pressing a surface of a polishing tape against the peripheral portion while protecting a central portion of the surface of the substrate from foreign matter produced by the polishing of the peripheral portion of the substrate.

According to the present invention, by carrying out conditioning of a surface of a polishing tape in advance in order to prevent abrasive particles from falling off the surface of the polishing tape during polishing, it becomes possible to effectively prevent the abrasive particles from falling off the surface of the polishing tape during polishing of the substrate and polish the substrate in a cleaner condition.

Further, according to the present invention, during polishing of a peripheral portion of a surface of a substrate by the polishing head, a central portion of the surface of the substrate can be protected from foreign matter produced by the polishing. Thus, even if abrasive particles fall off the polishing tape during the polishing, the fallen abrasive particles can be prevented from entering the central portion, e.g., the device area, of the surface of the substrate.

DETAILED DESCRIPTION OF THE PREFERRED EMBODIMENTS

Preferred embodiments of the present invention will now be described in detail with reference to the drawings. The following description illustrates an exemplary case in which a peripheral surface portion of a substrate, such as a semiconductor wafer having semiconductor devices in a surface, is polished to produce, for example, the above-described first silicon substrate (device substrate) having a semiconductor layer (SIO layer) in the surface and whose peripheral surface portion has been polished away.

Figure 1:
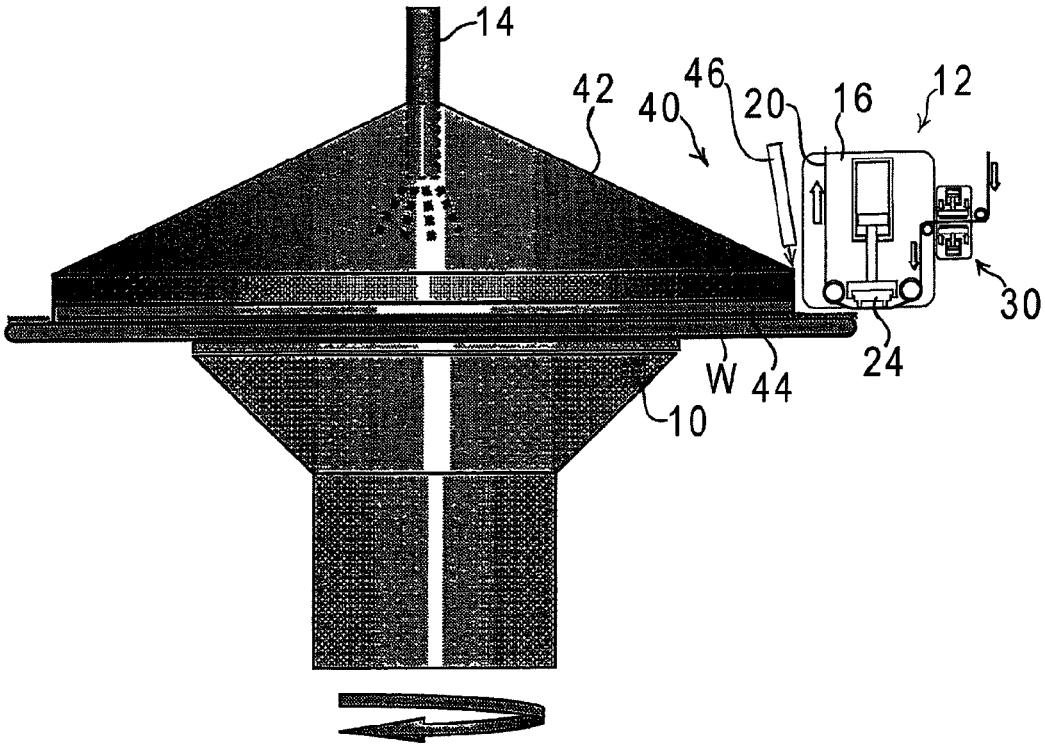
FIG. 1 is a schematic view of a polishing apparatus according to an embodiment of the present invention.

FIG. 1 schematically shows a polishing apparatus according to an embodiment of the present invention. As shown in FIG. 1, the polishing apparatus includes a substrate holder 10 for detachably holding, by attraction, and rotating a substrate W with a front surface (device surface) facing upwardly, a polishing head 12, disposed above the peripheral portion of the substrate W held on the substrate holder 10, for polishing the peripheral portion, and a fluid supply nozzle 14, disposed above the center of the substrate W held on the substrate holder 10, for supplying a fluid, such as pure water, to the surface of the substrate W.

Figure 2:
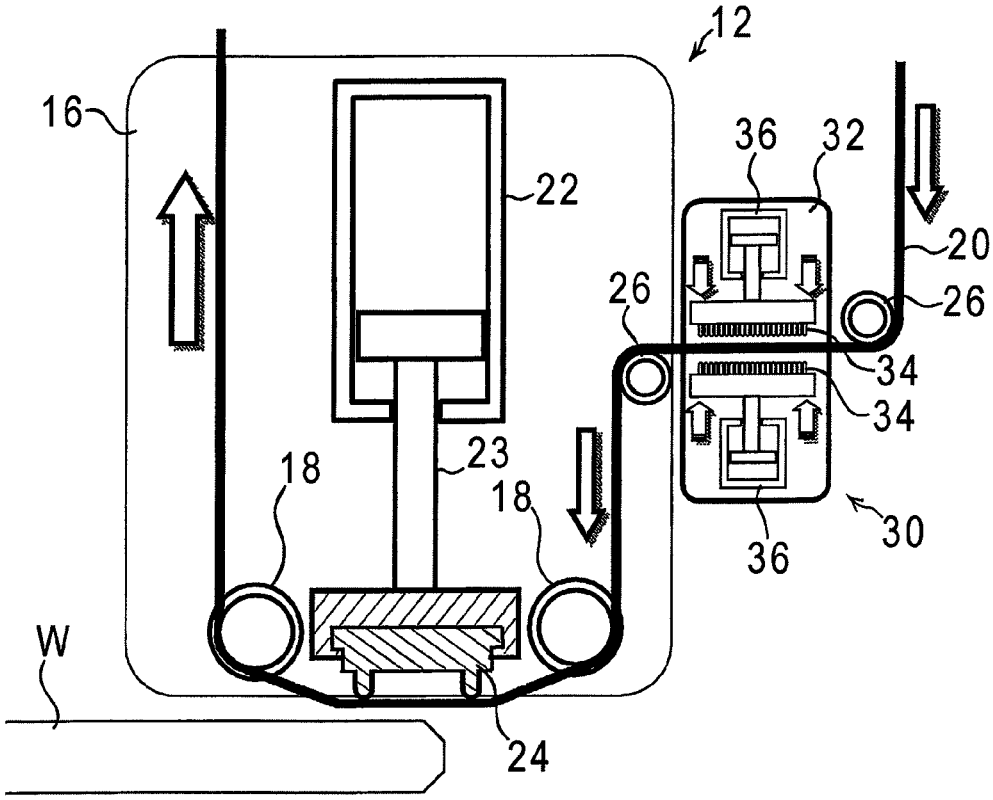
FIG. 2 is an enlarged view of a polishing head and a cleaning apparatus (conditioning apparatus) of the polishing apparatus shown in FIG. 1.

As shown in detail in FIG. 2, the polishing head 12 includes a vertically and horizontally movable support plate 16, and a pair of traveling rollers 18 disposed at a distance from each other and mounted to the support plate 16. Thus, a polishing tape 20, having abrasive particles (polishing material), such as diamond or ceria particles, fixed on a front surface, is configured to travel horizontally with the front surface (abrasive surface) facing downwardly in one direction between the traveling rollers 18. Above the polishing tape 20 lying between the traveling rollers 18 is disposed a downward-facing cylinder 22 as a lifting mechanism, and a pressing pad 24 is secured to a cylinder rod 23 of the cylinder 22. Thus, by lowering the pressing pad 24 by the cylinder 22, the front surface (lower surface) of the polishing tape 20 lying between the traveling rollers 18 can be pressed against the surface of the substrate W, held on the substrate holder 10, at a predetermined pressure.

The polishing tape 20 is configured to travel horizontally by a pair of guide rollers 26 disposed upstream of the polishing head 12 in the traveling direction of the polishing tape 20 and, in this embodiment, a cleaning apparatus 30 as a conditioning apparatus is disposed in a horizontal travel section. The cleaning apparatus (conditioning apparatus) 30 is to condition the surface of the polishing tape 20 in advance in order to prevent abrasive particles from falling off the surface of the polishing tape 20 during polishing, and includes a housing 32 in which the polishing tape 20 travels horizontally, a pair of cleaning brushes (rubbing tools) 34 located in the housing 32 and disposed above and below the polishing tape 20, and a pair of cylinders 36 as a lifting device for moving up and down each cleaning brush 34.

Figure 3:
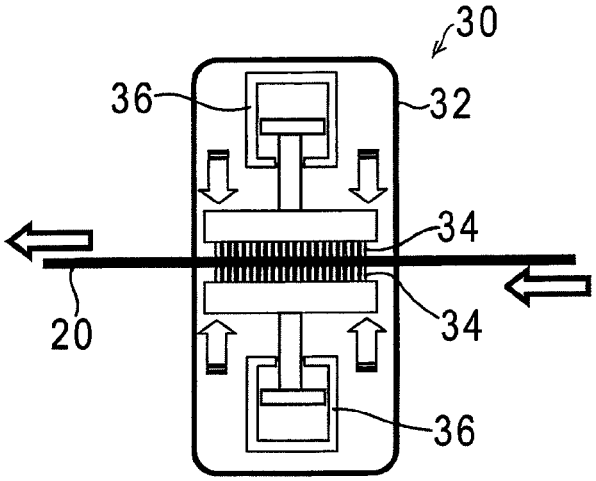
FIG. 3 is a diagram illustrating the cleaning apparatus of FIG. 2 upon cleaning of a polishing tape.

In operation, as shown in FIG. 3, the front ends of the pair of cleaning brushes 34, disposed above and below the polishing tape 20, are brought into contact with the back and front surfaces of the polishing tape 20 at a predetermined pressure while allowing the polishing tape 20 to travel in one direction, thereby rubbing the cleaning brushes 34 against the back and front surfaces of the polishing tape 20. Thus, in this embodiment, conditioning (cleaning) of the front surface of the polishing tape 20 with the lower cleaning brush 34 and cleaning of the back surface of the polishing tape 20 with the upper cleaning brush 34 are performed simultaneously.

In particular, the front and back surfaces of the polishing tape 20 are cleaned by rubbing the surfaces with the cleaning brushes 34. Further, the abrasive particles fixed on the front surface of the polishing tape 20, which have low adhesion to the polishing tape 20, are rubbed off and removed by the lower cleaning brush 34 from the front surface of the polishing tape 20. The front surface of the polishing tape 20 is thus conditioned. By removing those abrasive particles, which have low adhesion to the polishing tape 20, from the surface of the polishing tape 20 prior to polishing, abrasive particles can be effectively prevented from falling off the surface of the polishing tape 20 during polishing. Furthermore, polishing of a substrate with the polishing tape 20 can be carried out in a cleaner environment by cleaning the front and back surfaces of the polishing tape 20 in advance.

Figure 4:
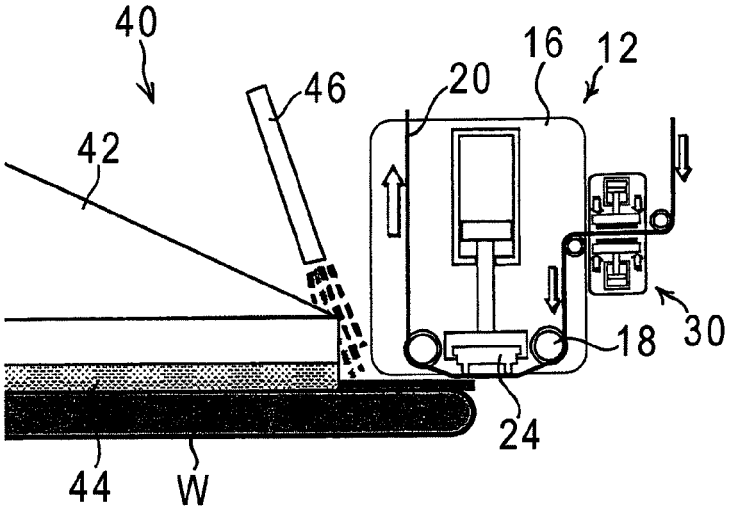
FIG. 4 is an enlarged view of a portion of the polishing apparatus shown in FIG. 1, illustrating an exemplary operation of the apparatus upon polishing.

As shown in FIG. 1, the polishing apparatus includes a surface protection apparatus 40 for protecting the central portion of the surface of the substrate W from foreign matter, which may be produced by polishing, during polishing of the peripheral portion of the surface of the substrate W by the polishing head 12. As shown in detail in FIG. 4, the surface protection apparatus 40 includes a vertically movable protective cover 42 having a conical shape projecting upward and centrally inserting the liquid supply nozzle 14 into the inside of the protective cover 42, a protective ring 44 as a shielding tool, coupled to a lower end of the protective cover 42, and a fluid blowing nozzle 46 for blowing a fluid toward the boundary between the central portion and the peripheral portion of the surface of the substrate W. The protective cover 42 is a rigid body, e.g., made of a resin.

The protective ring (shielding tool) 44 has, for example, such a diameter that it surrounds the circumference of a device area of the surface of the substrate W, so that above the device area of the surface of the substrate W will be covered with the conical protective cover 42. The boundary between the central portion and the peripheral portion of the surface of the substrate W lies in the vicinity of the boundary between the device area and the non-device area of the surface of the substrate W.

In this embodiment, the protective ring 44 is comprised of a PVA sponge, and a lower end of the protective ring 44 comes into contact with the surface of the substrate W, held on the substrate holder 10, so that even if abrasive particles, fixed on the surface of the polishing tape 20, fall off the surface of the polishing tape 20 during polishing of the peripheral portion of the surface of the substrate W with the polishing tape 20, the fallen abrasive particles, a fluid containing fallen abrasive particles, etc. will not enter the inside of the protective ring 44.

The use of a PVA sponge as the protective ring 44 can prevent the protective ring 44 from damaging the substrate W due to their contact. Further, a PVA sponge, which is a continuously foamed body, can absorb a fluid such as pure water, and the protective ring 44 can effectively prevent a contaminated fluid from intruding into the inside of the protective ring 44 by a form layer. Furthermore, the contaminated fluid, which has been absorbed into the PVA sponge, can be forced out of the PVA sponge to promote removal of contaminated fluid.

In this embodiment, by covering the central portion of the substrate W with the protective cover 42, abrasive particles which have fallen off the surface of the polishing tape 20, a fluid containing fallen abrasive particles, etc., even in a mist form, can be prevented from entering inside the protective ring 44 from above the substrate W. Because the protective cover 42 has a conical shape, a liquid, which has fallen to an upper surface of the protective cover 42 and gathered to a certain amount, is allowed to flow as a droplet along the upper surface of the protective cover 42.

Further, by supplying a liquid, such as pure water, to the surface of the substrate W from the liquid supply nozzle 14 extending inside the protective cover 42, the surface of the substrate W can be protected with the liquid. Instead of a liquid, it is possible to introduce a gas, such as nitrogen gas, into the inside of the protective cover 42 in order to reduce the running cost by suppressing consumption of the liquid, such as pure water.

The fluid blowing nozzle 46 is inclined outwardly with respect to the surface of the substrate, held on the substrate holder 10, so that the fluid, which has been blown from the fluid blowing nozzle 46 and collided against the substrate W, flows outwardly in the radial direction of the substrate W. As with the protective ring 44, even if abrasive particles, fixed on the surface of the polishing tape 20, fall off the surface of the polishing tape 20 during polishing of the peripheral portion of the surface of the substrate W with the polishing tape 20, the fallen abrasive particles or a liquid containing fallen abrasive particles can be forced out of the substrate W by the fluid blowing from the fluid blowing nozzle 46 toward the substrate W held on the substrate holder 10. The fallen abrasive particles or a liquid containing fallen abrasive particles can thus be prevented from entering the central portion, e.g., the device area, of the substrate W.

Pure water is preferably used as a fluid to be blown from the fluid blowing nozzle 46. However, instead of pure water, a liquid chemical, ionized water, ozone water, etc. may also be used. It is also possible to use a gas, such as air or nitrogen gas, containing no contaminant.

The surface protection apparatus 40 of this embodiment includes the protective ring 44 and the fluid blowing nozzle 46 so as to completely prevent fallen abrasive particles or a liquid containing fallen abrasive particles from entering the central portion, e.g., the device area, of a substrate W. It is, however, possible to provide only one of the protective ring 44 and the fluid blowing nozzle 46, or to selectively use one of the protective ring 44 and the fluid blowing nozzle 46, e.g., according to the polishing conditions.

The surface protection apparatus 40 may be omitted in cases where there is no fear of fallen abrasive particles or a liquid containing fallen abrasive particles entering the central portion, e.g., the device area, of the substrate W, or in cases where intrusion of abrasive particles or a liquid containing fallen abrasive particles into the central portion of the substrate W causes no problem.

The operation of the polishing apparatus upon polishing of a peripheral portion of a surface of a substrate W will now be described.

First, a substrate W is held by the substrate holder 10, and then the lower end of the protective ring 44 is brought into contact with the surface of the substrate W, thereby covering the central portion, except for the peripheral portion, of the surface of the substrate W with the protective cover 42. Thereafter, while rotating the substrate W held on the substrate holder 10, a liquid, such as pure water, is supplied from the liquid supply nozzle 14 to the surface of the substrate W and, if necessary, a liquid, such as pure water, is blown from the fluid blowing nozzle 46 toward the boundary between the central portion and the peripheral portion of the surface of the substrate W.

The polishing head 12, on the other hand, is moved from a stand-by position to a position above the peripheral portion of the substrate W held on the substrate holder 10 and from which polishing is intended to be started. Then, while allowing the polishing tape 20 to travel at a certain speed in one direction, the pressing pad 24 is lowered to press the front surface of the polishing tape 20 against the substrate W, thereby polishing the peripheral portion of the substrate W with the frictional force produced between the substrate W and the polishing tape 20 due to the relative speed difference.

During the polishing, the cleaning apparatus (conditioning apparatus) 30 is actuated to bring the front ends of the cleaning brushes 34 into contact with the front and back surfaces of the polishing tape 20, respectively, thereby simultaneously carrying out cleaning of the front and back surfaces of the polishing tape 20 with the cleaning brushes 34 and conditioning of the front surface of the polishing tape 20 with the lower cleaning brush 34, i.e., removal of those abrasive particles of the abrasive particles fixed on the front surface of the polishing tape 20 which have low adhesion to the polishing tape 20. The polishing tape 20 that has passed through the cleaning apparatus 30 travels between the traveling rollers 18.

The polishing with the polishing tape 20 is carried out while moving the polishing head 12 outwardly in the radial direction of the substrate W, and the polishing is terminated when the polishing head 12 reaches the edge of the substrate W. Thus, the polishing starting position or the polishing distance can be arbitrarily changed. After completion of the polishing, the travel of the polishing tape 20 is stopped, the polishing head 12 is raised and returned to the stand-by position, and the supply of the liquid from the liquid supply nozzle 14, the blowing of the fluid from the fluid blowing nozzle 46 and the rotation of the substrate W are stopped. Further, the protective ring 44 is detached from the surface of the substrate W, and the substrate W after polishing is sent to the next process.

The traveling speed of the polishing tape 20 during polishing is, for example, 1 to 50 mm/min, and the pressure of the polishing tape 20 on the substrate W is, for example, 5 to 20 N. The rotating speed of the substrate W is, for example, 100 to 400 rpm. A diamond tape having #2000 or less diamond abrasive particles (particle size: not less than 9 μm) fixed on the surface, for example, can be used as the polishing tape 20.

During the polishing, by supplying the liquid, such as pure water, from the liquid supply nozzle 14 to the surface of the substrate W and thereby covering the surface with the liquid, the central portion, e.g., the device area, of the surface of the substrate W can be protected from dust. The liquid, supplied to the surface of the substrate W during the polishing, passes through the interior of the protective ring 44 of PVA sponge and reaches the peripheral portion of the substrate W. Thus, polishing of the peripheral portion of the substrate W with the polishing tape 20 is carried out in the presence of the liquid. The liquid that has reached the peripheral portion of the substrate W is stemmed by the protective ring 44 and prevented from flowing into the inside of the protective ring 44.

According to this embodiment, of the abrasive particles fixed on the surface of the polishing tape 20, those particles, which have low adhesion to the polishing tape 20, can be rubbed off and removed by the lower cleaning brush 34 from the surface of the polishing tape 20 while performing cleaning of the front and back surfaces of the polishing tape 20 with the pair of cleaning brushes 34. This can effectively prevent abrasive particles from falling off the surface of the polishing tape 20 during polishing and, in addition, can perform polishing in a clean environment.

Further, even if abrasive particles fall off the surface of the polishing tape 20 during the polishing and the fallen abrasive particles are mixed into the liquid that has supplied from the liquid supply nozzle 14 to the surface of the substrate W and reached the peripheral portion of the substrate W, the liquid containing the abrasive particles is stemmed by the protective ring 44 and prevented from flowing into the inside of the protective ring 44 and, in addition, is forced out of the substrate W by the fluid blowing from the fluid blowing nozzle 46 toward the substrate W. The central portion, e.g., the device area, of the surface of the substrate W can thus be protected from the abrasive particles that fell off the surface of the polishing tape 20.

Though in this embodiment, the front ends of the cleaning brushes 34 are pressed against the polishing tape 20 at a predetermined pressure by the cylinders 36, it is also possible to rotate the cleaning brushes 34 or to reciprocate the cleaning brushes 34 in a certain distance in the width direction or the length direction of the polishing tape 20. The hardness of abrasive particles fixed on a polishing tape is generally higher than the hardness of a cleaning brush itself. Therefore, a cleaning brush, if it wears off due to repeated use, will wear flatly. A cleaning brush thus is a long-life consumable which can be used without change in the flatness.

Though not depicted, during cleaning (conditioning) of a polishing tape with a cleaning brush, the cleaning brush may be cleaned with a fluid, such as pure water or a liquid chemical, so as to keep the brush clean. It is also possible to move a cleaning brush during times when cleaning (conditioning) of a polishing tape with the cleaning brush is not being performed, and clean the brush, e.g., with pure water or a liquid chemical, which may be ultrasonically vibrating, in a container such as a cup.

It is also possible to carry out cleaning (conditioning) of a polishing tape with a cleaning brush while supplying a fluid to the polishing tape. Abrasive particles, which have been removed by the cleaning brush from the surface of the polishing tape, together with impurities, can be rinsed off with the fluid. The use of an acidic solution as the fluid to be supplied to the polishing tape can effectively rinse off a metal substance adhering to the polishing tape, thereby minimizing contamination of a substrate with a metal.

Figure 5:
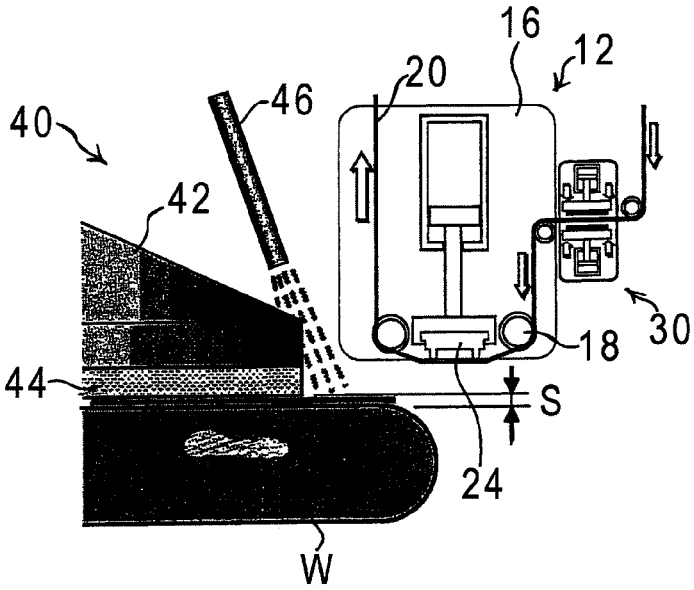
FIG. 5 is an enlarged view of a portion of the polishing apparatus shown in FIG. 1, illustrating another exemplary operation of the apparatus upon polishing.

As shown in FIG. 5, during the polishing of the peripheral portion of the substrate W with the polishing tape 20, a gap S, e.g., about 0.1 to 1.0 mm, which can stem the liquid that has reached the peripheral portion of the substrate W and thus prevent the liquid from flowing into the inside of the protective ring 44, may be provided between the lower end of the protective ring 44 of PVA sponge and the surface of the substrate W held on the substrate holder 10. By thus avoiding contact between the protective ring 44 and the substrate W, the life of the protective ring 44 can be significantly extended.

Figure 6:
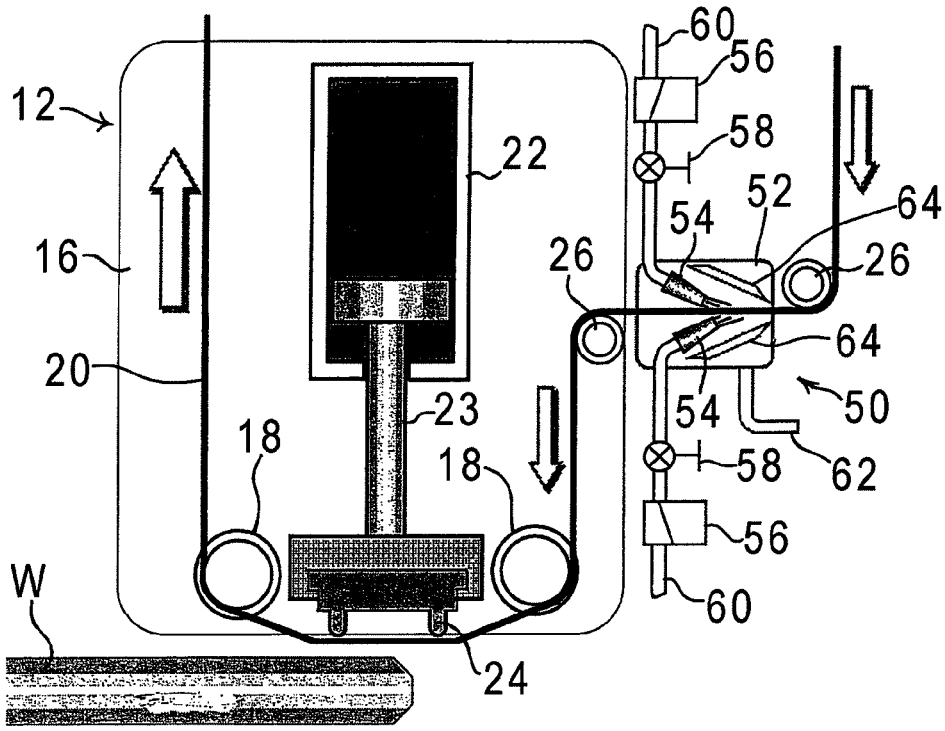
FIG. 6 is an enlarged view of the main portion of a polishing apparatus according to another embodiment of the present invention.

FIG. 6 shows the main portion of a polishing apparatus according to another embodiment of the present invention. This embodiment differs from the embodiment shown in FIGS. 1 through 4 in that instead of the cleaning apparatus 30, a fluid blowing apparatus 50 is used as a conditioning apparatus. The fluid blowing apparatus (conditioning apparatus) 50 includes a housing 52 in which the polishing tape 20 travels horizontally, and a pair of fluid blowing nozzles 54 located in the housing 52 and disposed above and below the polishing tape 20. Each fluid blowing nozzle 54 is connected to a fluid supply pipe 60 extending from a not-shown fluid supply source and provided with a regulator 56 and a valve 58.

A drain or exhaust pipe 62 is connected to the bottom of the housing 52. A pair of regulating plates 64 for regulating the flow of a fluid blowing from each fluid blowing nozzle 54 is disposed in the housing 52. The regulating plate 64 functions to prevent scattering of a liquid when the liquid is used as the fluid, or to regulate the flow of a gas when the gas is used as the fluid.

In operation of the fluid blowing apparatus 50, the polishing tape 20 is allowed to travel in one direction while blowing a fluid, e.g., high-pressure air, toward the polishing tape 20 from the pair of fluid blowing nozzles 54 disposed above and below the polishing tape 20. Thus, in this embodiment, conditioning (cleaning) of the front surface of the polishing tape 20 with high-pressure air and cleaning of the back surface of the polishing tape 20 with high-pressure air can be performed simultaneously. The high-pressure air is blown at a predetermined pressure and flow rate from each fluid blowing nozzle 54.

In particular, the front and back surfaces of the polishing tape 20 can be cleaned with the high-pressure air blowing from the fluid blowing nozzles 54. Further, the abrasive particles fixed on the front surface of the polishing tape 20, which have low adhesion to the polishing tape 20, can be blown off and removed from the front surface of the polishing tape 20 with the high-pressure air blowing from the lower fluid blowing nozzle 54. The front surface of the polishing tape 20 can thus be conditioned.

Besides air, any other gas with few impurities, such as nitrogen gas, may be selected and used according to the environment. When blowing high-pressure air (or nitrogen gas, etc.), it is preferred to control the distance between each fluid blowing nozzle 54 and the polishing tape 20 at such a distance as to optimize the cleaning performance. In addition to thus controlling the positions of the fluid blowing nozzles 54, it is preferred to reciprocate each fluid blowing nozzle 54 in a certain range in the horizontal direction and the vertical direction with respect to the polishing tape 20. This enables the fluid blowing nozzle 54 to blow high-pressure air (or nitrogen gas, etc.) onto a wider area of the polishing tape 20. This holds true for the below-described case of blowing a liquid from the fluid blowing nozzles 54.

High-pressure air (or nitrogen gas, etc.) may be blown either continuously or intermittently from the fluid blowing nozzle 54 toward the polishing tape 20 at a certain flow rate over a certain period of time. Intermittent blowing of high-pressure air (or nitrogen gas, etc.) can reduce the amount of the high-pressure air (or nitrogen gas, etc.) used. Furthermore, the intermittent blowing applies force to the polishing tape 20 in an intermittent manner. This can enhance the cleaning effect and the effect of removing abrasive particles having low adhesion to the polishing tape 20. The same holds true for the below-described case of blowing a liquid from the fluid blowing nozzles 54.

A liquid, such as pure water, may be used as the fluid of the fluid blowing apparatus 50. In this case, the polishing tape 20 is allowed to travel in one direction while blowing a high-pressure liquid toward the polishing tape 20 from the pair of fluid blowing nozzles 54 disposed above and below the polishing tape 20. Thus, in this case, conditioning (cleaning) of the front surface of the polishing tape 20 with the high-pressure liquid and cleaning of the back surface of the polishing tape 20 with the high-pressure liquid can be performed simultaneously. The high-pressure liquid is blown at a predetermined pressure and flow rate from each fluid blowing nozzle 54.

In view of electrostatic adhesion of dust, etc., to the polishing tape 20, ionized water may be used as the fluid. It is also possible to use ozone water as the fluid for effective removal of dust. Alternatively, a liquid chemical may be used as the fluid to effectively remove abrasive particles, having low adhesion to the polishing tape 20, from the polishing tape 20. The use of a weakly acidic liquid chemical as the fluid can effectively remove a metal substance adhering to the surface of the polishing tape 20, thus reducing adhesion of a metal substance to a surface of a substrate W.

Blowing a high-pressure fluid onto a polishing tape can apply a sufficient load to the polishing tape so that abrasive particles having low adhesion to the polishing tape, contaminants, etc. can be removed. The front end of the fluid blowing nozzle 54 for blowing the fluid may have a round nozzle shape that can blow a fluid at a high pressure, or have a fan-like nozzle shape that can blow a fluid onto a wide area.

The polishing characteristics can be controlled and changed by controlling the temperature of the fluid, to be blown from the fluid blowing apparatus 50, e.g., in the range of 0° C. to 90° C. In particular, by changing the temperature of the fluid to a low temperature of 0° C. to 20° C., the resin binder of the polishing tape 20 holding abrasive particles can be hardened, whereby the abrasive particle holding power of the binder resin can be increased. This can increase the polishing rate for a substrate W. In contrast, by changing the temperature of the fluid to a high temperature of 20° C. to 90° C., the resin binder of the polishing tape 20 holding abrasive particles can be softened, whereby the abrasive particle holding power of the binder resin can be decreased. This can decrease the polishing rate for a substrate W. By decreasing the polishing rate for a substrate W, the depth of a polishing trace produced by polishing can be decreased.

It is possible to blow a fluid from a fluid blowing nozzle toward a polishing tape while slightly vibrating, such as by ultrasonic vibration, the polishing tape, or to use an ultrasonically-vibrating fluid. This enables more effective cleaning (conditioning) of the polishing tape. In this case, an acid solution may be used as the fluid for effective metal cleaning, or an alkali cleaning water may be used as the fluid for effective removal of impurities such as dust.

Figure 7:
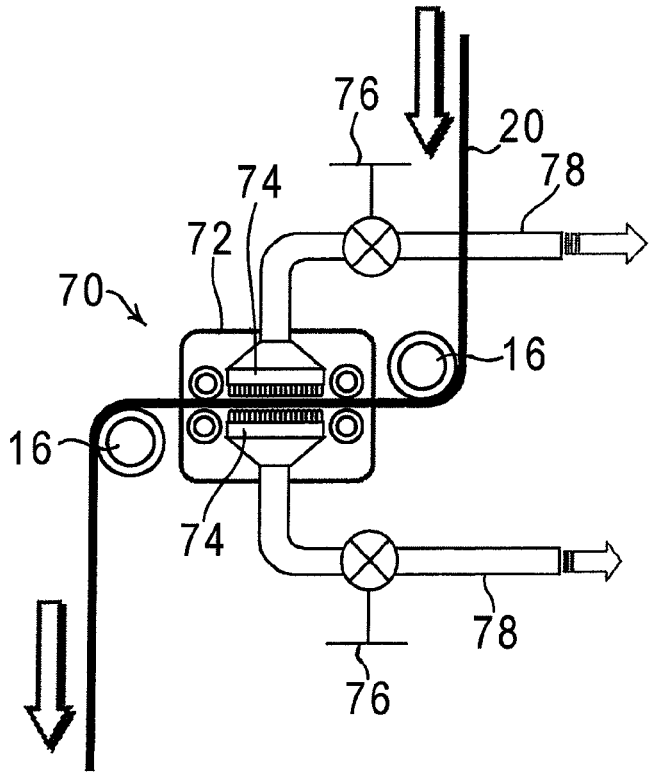
FIG. 7 is an enlarged view of the main portion of a suction apparatus (conditioning apparatus) provided in a polishing apparatus according to yet another embodiment of the present invention.

FIG. 7 shows a suction apparatus 70 for use as a conditioning apparatus in a polishing apparatus according to yet another embodiment of the present invention. The suction apparatus 70 shown in FIG. 7 can be used instead of the cleaning apparatus 30 of the polishing apparatus shown in FIGS. 1 through 4. The suction apparatus (conditioning apparatus) 70 includes a housing 72 in which the polishing tape 20 travels horizontally, and a pair of suction heads 74 located in the housing 72 and disposed above and below the polishing tape 20. Each suction head 74 is connected to one end of a suction pipe 78 in which a valve 76 is installed, and the other end of the suction pipe 78 is connected to a vacuum source.

In operation of the suction apparatus 70, the polishing tape 20 is allowed to travel in one direction while applying vacuum suction to the back and front surfaces of the polishing tape 20 from the pair of suction heads 74 disposed above and below the polishing tape 20. Thus, in this embodiment, conditioning (cleaning) of the front surface of the polishing tape 20 by the application of vacuum suction and cleaning of the back surface of the polishing tape 20 by the application of vacuum suction can be performed simultaneously.

In particular, the front and back surfaces of the polishing tape 20 can be cleaned by the application of vacuum suction from the suction heads 74. Further, the abrasive particles fixed on the front surface of the polishing tape 20, which have low adhesion to the polishing tape 20, can be sucked and removed from the front surface of the polishing tape 20 by the application of vacuum suction from the lower suction head 74. The front surface of the polishing tape 20 can thus be conditioned.

Though not depicted, a pair of brushes or the like, which make contact with the front and back surfaces of the polishing tape 20, are preferably provided upstream of the suction heads 74 in the flow direction of the polishing tape 20. By rubbing the front and back surfaces of the polishing tape 20 with the brushes or the like, conditioning (cleaning) of the front surface of the polishing tape 20 by the application of vacuum suction and cleaning of the back surface of the polishing tape 20 by the application of vacuum suction can be performed more effectively.

Figure 8:
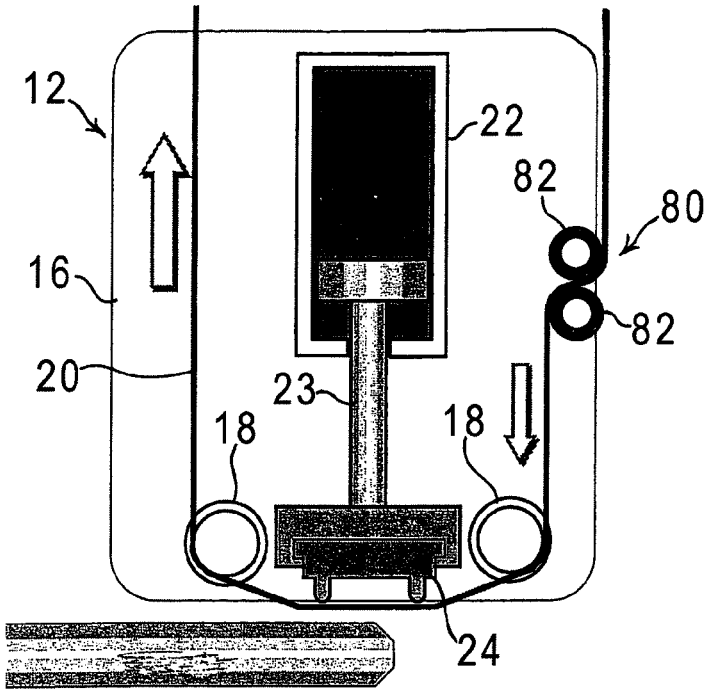
FIG. 8 is an enlarged view of the main portion of a polishing apparatus according to yet another embodiment of the present invention.

FIG. 8 shows the main portion of a conditioning apparatus of a polishing apparatus according to yet another embodiment of the present invention. This embodiment differs from the embodiment shown in FIGS. 1 through 4 in that instead of the cleaning apparatus 30, an adhesive contact apparatus 80 is used as a conditioning apparatus. The adhesive contact apparatus (conditioning apparatus) 80 includes a pair of upper and lower adhesive rolls 82 coated with an adhesive having an adhesive surface. The polishing tape 20 is nipped between the adhesive rolls 82 and is allowed to travel in one direction by synchronously rotating the adhesive rolls 82 in opposite directions.

In operation of the adhesive contact apparatus 80, the upper and lower adhesive rolls 82, in contact with the back surface and the front surface of the polishing tape 20, respectively, are synchronously rotated in opposite directions so as to allow the polishing tape 20 to travel in one direction. Thus, in this embodiment, conditioning (cleaning) of the front surface of the polishing tape 20 with the lower adhesive roll 82 and cleaning of the back surface of the polishing tape 20 with the upper adhesive roll 82 can be performed simultaneously.

In particular, the front and back surfaces of the polishing tape 20 are brought into contact with the adhesive coating surfaces of the adhesive rolls 82, and dust, etc. on the polishing tape 20 adheres to the adhesive of the adhesive rolls 82 and thus is removed from the polishing tape 20. Further, of the abrasive particles fixed on the front surface of the polishing tape 20, those abrasive particles, which have low adhesion to the polishing tape 20, adhere to the adhesive of the lower adhesive roll 82 and thus are removed from the front surface of the polishing tape 20. The front surface of the polishing tape 20 can thus be conditioned.

The adhesive rolls 82 are set in the polishing apparatus after carrying out necessary cleaning of the adhesive rolls 82, especially cleaning with an acid to prevent metal contamination of a substrate, so as to remove contaminants from the adhesive. Though not depicted, it is preferred to provide a mechanism for slightly vibrating, such as by ultrasonic vibration, the adhesive rolls 82 to add the vibrating movement to those portions of the polishing tape 20 which are in contact with the adhesive rolls 82. This enables more effective removal of abrasive particles, having low adhesion to the polishing tape 20, from the surface of the polishing tape 20.

Figure 9:
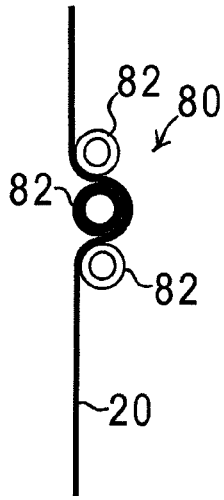
FIG. 9 is a diagram showing a variation of an adhesive contact apparatus (conditioning apparatus) of the polishing apparatus shown in FIG. 8.
Figure 10:
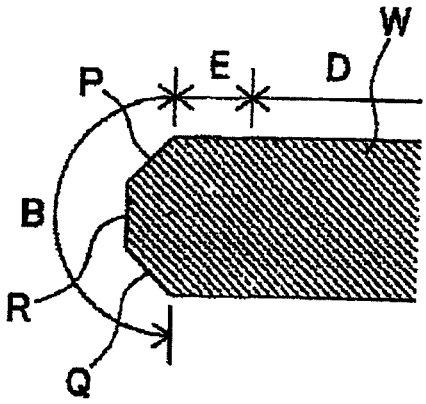
FIG. 10 is a cross-sectional diagram illustrating a bevel portion and an edge portion of a semiconductor wafer.

As shown in FIG. 9, it is possible to use an adhesive contact apparatus 80 which employs three adhesive rolls 82 so as to ensure a wider contact area between the adhesive rolls 82 and the polishing tape 20.

Though not depicted, instead of the cleaning apparatus 30 having the pair of cleaning brushes 34, shown in FIGS. 1 through 4, it is possible to use a polishing apparatus which employs a pair of grinding stones in place of the pair of cleaning brushes 34. By pressing and rubbing the grinding stones against the front and back surfaces of a polishing tape, conditioning (cleaning) of the front surface of the polishing tape by grinding with the lower grinding stone, and cleaning of the back surface of the polishing tape by grinding with the upper grinding stone can be performed simultaneously.

The pressure of each grinding stone on a polishing tape upon rubbing of the polishing tape needs to be controlled. The pressure can be easily controlled, e.g., by a cylinder. The flatness of the grinding stone surface to be made contact with a polishing tape should preferably be measured and controlled before setting the grinding stone in the polishing apparatus.

This can prevent a local pressure from being applied to the polishing tape. Immediately before setting the grinding stones in the polishing apparatus, the grinding stones should preferably be cleaned, e.g., with an acid to prevent the grinding stones from contaminating a polishing tape. A metal substance adhering to the grinding stones can be rinsed off by cleaning with an acid.

The grinding stones may be reciprocated in a certain distance in the vertical direction or the horizontal direction with respect to a polishing tape. Contact of the grinding stones with a polishing tape may be made in an intermittent manner so that a force is intermittently applied to the polishing tape. This can enhance the cleaning effect and the effect of removing abrasive particles having low adhesion to the polishing tape. By moving each grinding stone having surface flatness initially, it can be evenly rubbed against a polishing tape. Therefore, the grinding stone, if it wears off due to contact with the polishing tape, will wear evenly. It thus becomes possible to use the grinding stone while maintaining its surface flatness and use it over a long period of time.

It is preferred to carry out polishing of a polishing tape with the grinding stones while supplying a fluid to the grinding stones. Abrasive particles, which have low adhesion to the polishing tape and which have been removed by the polishing with grinding stones from the binder of the polishing tape, can be rinsed off with the fluid. The use of an acidic solution as the fluid can effectively rinse off a metal substance adhered to the polishing tape upon its production. It is possible to slightly vibrate, e.g., ultrasonically, the grinding stones upon their contact with a polishing tape, or to slightly vibrate, e.g., ultrasonically, a polishing tape upon its contact with the grinding stones. This enables more effective cleaning of the polishing tape and removal of abrasive particles, having low adhesion to the polishing tape, from the surface of the polishing tape.

While the present invention has been described with reference to preferred embodiments, it is understood that the present invention is not limited to the embodiments described above, but is capable of various changes and modifications within the scope of the inventive concept as expressed herein.

What is claimed is:

1. A polishing apparatus comprising:

a polishing head for polishing a peripheral portion of a substrate by pressing a surface of a polishing tape, having abrasive particles fixed on the surface, against the peripheral portion of the substrate while allowing the polishing tape to travel in one direction; and a conditioning apparatus, disposed upstream of the polishing head in the traveling direction of the polishing tape, for conditioning the surface of the polishing tape in advance in order to prevent the abrasive particles from falling off the surface of the polishing tape during polishing.

2. The polishing apparatus according to claim 1, wherein the conditioning apparatus is a cleaning apparatus for cleaning the surface of the polishing tape by rubbing a rubbing tool against the surface of the polishing tape.

3. The polishing apparatus according to claim 2, wherein the rubbing tool is a cleaning brush.

4. The polishing apparatus according to claim 2, further comprising a cleaning tool for cleaning the rubbing tool.

5. The polishing apparatus according to claim 1, wherein the conditioning apparatus is a fluid blowing apparatus for blowing a fluid toward the surface of the polishing tape.

6. The polishing apparatus according to claim 5, wherein the fluid is an ultrasonically-vibrating fluid.

7. The polishing apparatus according to claim 1, wherein the conditioning apparatus is a suction apparatus for applying suction to the surface of the polishing tape.

8. The polishing apparatus according to claim 1, wherein the conditioning apparatus is a polishing apparatus for polishing the surface of the polishing tape by pressing a grinding stone against the surface of the polishing pad.

9. The polishing apparatus according to claim 1, wherein the conditioning apparatus is an adhesive contact apparatus for bringing an adhesive having an adhesive surface into contact with the surface of the polishing tape.

10. A polishing apparatus comprising:

a polishing head for polishing a peripheral portion of a substrate by pressing a surface of a polishing tape, having abrasive particles fixed on the surface, against the peripheral portion of the substrate while allowing the polishing tape to travel in one direction; and a surface protection apparatus, during polishing of the peripheral portion of the substrate by the polishing head, for protecting a central portion of the surface of the substrate from foreign matter produced by the polishing, wherein the surface protection apparatus includes at least one of a shielding tool for surrounding and protecting the central portion of the surface of the substrate in such a manner as to prevent passage of the foreign matter therethrough and a fluid blowing nozzle for blowing a fluid toward the boundary between the central portion and the peripheral portion of the substrate.

11. The polishing apparatus according to claim 10, wherein the shielding tool is a PVA sponge disposed in contact with the surface of the substrate.

12. A polishing method comprising:

conditioning a surface of a polishing tape in order to prevent abrasive particles from falling off the surface of the polishing tape during polishing; and polishing a peripheral portion of a substrate by pressing the conditioned surface of the polishing tape against the peripheral portion of the substrate.

* * * * *